US005511128A

United States Patent [19]

Lindemann

[11] Patent Number: 5,511,128

[45] Date of Patent: Apr. 23, 1996

[54] DYNAMIC INTENSITY BEAMFORMING SYSTEM FOR NOISE REDUCTION IN A BINAURAL HEARING AID

[76] Inventor: Eric Lindemann, 2975 18th St., Boulder, Colo. 80304

[21] Appl. No.: 184,724

[22] Filed: Jan. 21, 1994

[51] Int. Cl.[6] ..... H04R 3/00

[52] U.S. Cl. ..... 381/92; 381/155

[58] Field of Search ..... 381/92, 155, 122, 381/168; 367/99–101

[56] References Cited

U.S. PATENT DOCUMENTS

| | | | |
|---|---|---|---|
| 4,536,887 | 8/1985 | Kaneda et al. | 381/92 |
| 4,628,529 | 12/1986 | Borth et al. | 381/94 |
| 4,630,305 | 12/1986 | Borth et al. | 381/94 |
| 4,696,043 | 9/1987 | Iwahara et al. | 381/92 |
| 4,703,506 | 10/1987 | Sakamoto et al. | 381/92 |
| 4,868,880 | 9/1989 | Bennett, Jr. | 381/68.2 |
| 4,887,299 | 12/1989 | Cummins et al. | 381/68.4 |
| 5,029,216 | 7/1991 | Jhabuala et al. | 381/92 |
| 5,029,217 | 7/1991 | Chabries et al. | 381/68.2 |

OTHER PUBLICATIONS

"An Alternative Approach to Linearly Constrained Adaprive Beamforming" By L. J. Griffiths et al, IEEE Transactions, vol. AP–30, No. 1, Jan. 1982, pp. 27–34.

Article Entitled "Extension of a Binaural Cross–Correlation Model By Contralateral Inhibition" By W. Lindemann, J. Acoust. Soc. Am. 80(6), Dec. 1986, pp. 1608–1622.

"Multimicrophone Adaptive Beamforming for Interference Reduction In Hearing Aids" By P. Peterson et al, Journal Of Rehibilitation . . . , vol. 24, No. 4.

"Improvement of Speech Intelligibility In Noise Development and Evaluation of a New Directional Hearing Instrument Based On Array Technology" by W. Soede, Delft Univ. of Technology.

Article Entitled "Evaluation of An Adaptive Beamforming Method for Hearing Aids" By J. Greenberg et al, J. Acoust. Soc. Am. 91 (3) Mar. 1992, pp. 1662–1676.

"Digital Signal Processing for Binaural Hearing Aids" By Kollmeier et al, Proceedings International Congress On Acoustics, 1992, Beijing.

Article Entitled "Cocktail–Party–Processing: Concept and Results" By M. Bodden, Bodden Proceedings, 1992, Beijing, China.

*Primary Examiner*—Stephen Brinich

*Attorney, Agent, or Firm*—Homer L. Knearl; Holland & Hart

[57] ABSTRACT

An audio signal in a hearing aid is enhanced by detecting the power of the desired audio signal and the power of the total audio signal, generating a power value and making a noise-reduction adjustment or no noise-reduction adjustment based on the power value. In one embodiment, the power value is a function of the total power of the audio signal. In a second embodiment the power value is a function of the ratio of:the power of the desired audio signal to the power of the total audio signal.

When the noise reduction is accomplished with beamforming, the invention uses a direction estimate vector in combination with a beam intensity vector, which is based on the power value, to generate a beamforming gain vector. The direction estimate vector is scaled by the beam intensity vector; the product of the vectors is the beamforming gain vector. The beamforming gain vector is multiplied with the left and right signal frequency domain vectors to produce noise reduced left and right signal frequency domain vectors.

18 Claims, 4 Drawing Sheets

DYNAMIC INTENSITY BEAMFORMING SYSTEM FOR NOISE REDUCTION IN A BINAURAL HEARING AID

CROSS REFERENCE TO RELATED APPLICATIONS

The present invention is related to commonly-assigned patent application entitled "Binaural Hearing Aid," Ser. No. 08/123,499 filed Sep. 17,1993. This application describes a binaural hearing system in which the present invention could be used. The patent application is incorporated herein by reference.

The present invention is also related to commonly-assigned patent application entitled "Noise Reduction System For Binaural Hearing Aid,"Ser. No. 08/123,503, filed Sep. 17, 1993. This application is directed to a noise reduction system that is an alternative to the noise reduction system in the present invention. Either noise reduction system can be used the "Binaural Hearing Aid" invention cited above.

BACKGROUND OF THE INVENTION

1. Field of the Invention

This invention relates to binaural hearing aids, and more particularly, to a noise reduction system for use in a binaural hearing aid.

2. Description of Prior Art

Noise reduction, as applied to hearing aids, means the attenuation of undesired signals and the amplification of desired signals. Desired signals are usually speech that the hearing aid user is trying to understand. Undesired signals can be any sounds in the environment which interfere with the principal speaker. These undesired sounds can be other speakers, restaurant clatter, music, traffic noise, etc. There have been three main areas of research in noise reduction as applied to hearing aids: Directional beamforming, spectral subtraction, pitch-based speech enhancement.

The purpose of beamforming in a hearing aid is to create an illusion of "tunnel hearing" in which the listener hears what he is looking at, but does not hear sounds which are coming from other directions. If he looks in the direction of a desired sound—e.g., someone he is speaking to—then other distracting sounds—e.g., other speakers —will be attenuated. A beamformer then separates the desired "online" (line of sight) target signal from the undesired "off-line" jammer signals so that the target can be amplified while the jammer is attenuated.

Researchers have attempted to use beamforming to improve signal-to-noise ratio for hearing aids for a number of years (References 1, 2, 3, 5, 6, 7). Three main approaches have been proposed. The simplest approach is to use purely analog delay-and-sum techniques (2). A more sophisticated approach uses adaptive FIR filter techniques using algorithms, such as the Griffiths-Jim beamformer (1, 3). These adaptive filter techniques require digital signal processing and were originally developed in the context of antenna array beamforming for radar applications (4). Still another approach is motivated from a model of the human binaural hearing system (8, 9). While the first two approaches are time domain approaches, this last approach is a frequency domain approach.

There have been a number of problems associated with all of these approaches to beamforming. The delay-and-sum and adaptive filter approaches have tended to break down in non-anechoic, reverberant listening situations; any real room will have so many acoustic reflections coming off walls and ceilings that the adaptive filters will be largely unable to distinguish between desired sounds coming from the front and undesired sounds coming from other directions. The delay-and-sum and adaptive filter techniques have also required a large (>=8) number of microphone sensors to be effective. This has made it difficult to incorporate these systems into practical hearing aid packages. One package that has been proposed consists of a microphone array across the top of eyeglasses (2).

There are a number of additional problems to the beamforming approach to noise reduction that have not been solved by the above prior art beamformers. If the hearing aid wearer is trying to converse with more than one person at a time, such as in a dinner or cocktail party situation where there are three or four people participating in the conversation, then he must turn his head quickly to look first at one speaker then the next. In addition, if he is looking at one speaker, then he may not be able to tell when a new speaker has begun speaking since speakers other than the one he is looking at are attenuated. Another disadvantage to typical beamforming for noise reduction in hearing aids is the unnatural almost claustrophobic effect which the hearing aid wearer experiences. It limits the usefulness of beamforming to particular high noise situations, such as restaurants and parties, where the desire to communicate overshadows concerns of naturalness. Another problem is audible artifacts, resembling a water fall or babbling brook, which are most noticeable at low signal levels when no one is speaking, or when there are no significant sound sources in the room other than background ambiance: fans, heaters, etc.

SUMMARY OF THE INVENTION

It is an object of this invention to solve the above problems associated with signal discrimination devices such as beamformers.

It is a further object of this invention to restore naturalness to the sound and remove burbling artifacts from the sound produced by a hearing aid.

In accordance with this invention, the above problems are solved by signal discrimination apparatus detecting the power of a desired signal and the power of the total input signal, generating a power value from the detected power, and making desired signal separation adjustment based on the power value. In one embodiment, the power value is a function of the total power of the input signal. In a second embodiment, the power value is a function of the ratio of the power of the desired signal to the power of the total input signal.

The invention selectively processes a radiant energy signal received by a plurality of sensors oriented in a predetermined viewing direction. A beamformer responsive to the signals from the sensors separates online signals arriving at the sensors in a direction near the viewing direction from off-line signals arriving from other directions. Monitoring operations monitor all of the signals and determining a combined strength for all signals and an online strength for the online signals. Thereafter, logical operations responsive to the signal strength enable the beamformer when the signal strength is high and inhibit the beamformer when the signal strength is low.

When the invention is applied to a binaural hearing aid with beamforming, the invention uses a direction estimate vector in combination with a beam intensity vector, which is based on the power value, to generate a beamforming gain vector. The direction estimate vector is scaled by the beam intensity vector; the product of the vectors is the beamforming gain vector. The beamforming gain vector is multiplied with the left and right signal frequency domain vectors to produce noise reduced left and right signal frequency domain vectors.

The beam intensity vector describes, for each frequency, how much the direction estimate will affect the beamforming gain. If beam intensity equals one, then full direction estimate is applied and signals coming from directions, other than the look direction, will be heavily attenuated. If beam intensity equals zero, then no direction estimate is applied, and the beamforming gain is unity, regardless of direction of arrival. If beam intensity is between zero and one, then partial direction estimate is applied. The system is designed such that, except for periods of transition, the beam intensity is either one, full beamforming, or zero, no beamforming.

The beam intensity vector may be implemented in Mode One operation as a function of the power of the sum of the left and right signal frequency domain vectors. This power is measured in several subbands of the left and right sum signal frequency domain vector. The power in each subband determines the beam intensity in that subband. If the input signal power is low, the beam intensity is low, and the signal is allowed to pass through unattenuated regardless of direction of arrival. If the input signal power is high, the beam intensity is high, and direction of arrival will have a large affect on the beamforming gain in that subband.

The beam intensity vector is implemented in Mode Two operation as a function of a ratio between the online power of the input signal, the power after beamforming, and the total power of the input signal, the power before beamforming. (Online power is the power of the input signal arriving along the direction of sight.) If this ratio is high, indicating considerable online power compared to total power, then the effects of the beamforming are passed through to the hearing aid wearer. If this ratio is low, indicating little online power compared with total power, then the effects of the beamforming are reduced, and the original signal is allowed to pass through to the hearing aid wearer.

The result of Mode One operation is much the same as conventional beamformers, except that burbling artifacts, most noticeable at low level inputs, are gone, since at low levels beam intensity is low and there is little or no active beamforming. The result of Mode Two operation is that sounds not coming from the online, or look, direction are attenuated only if there are sounds of significant power coming from the look direction. If the hearing aid wearer is looking directly at someone who is talking, then in Mode One or Mode Two all other sounds are attenuated. If the speaker pauses or if the hearing aid wearer looks away, then in Mode Two, all sounds are delivered unattenuated, and in Mode One only the look direction sounds are unattenuated even if there are no significant look direction sounds. If the hearing aid wearer is in a conversation and is looking at a speaker and another person starts to speak, then if the first speaker pauses, the Mode Two operation will stop beamforming, and the hearing aid wearer will hear the other speaker. If the hearing aid wearer turns to look in the direction of the new speaker, the beamformer will become active again, since there will once again be significant online energy. If there is a general pause in the conversation, or if the hearing aid wearing leaves the conversation, then in Mode Two operation, the wearer will almost immediately hear all sounds unattenuated, providing a natural sound field.

There are adjustable attack-and-release time constants associated with the beam intensity vector and, therefore, with the turning on and off of beamforming. These time constants apply to both Mode One and Mode Two operation. The attack time constant is generally fast, on the order of tens of milli-seconds (for example, 20–30ms), while the release time constant is generally slow, on the order of a few hundred milli-seconds (for example, 500ms). The effect of the time constants is that, when there is a sudden increase in total power for Mode One or of online power relative to offline power for Mode Two, then beam intensity, assuming a fast attack, quickly goes up. If there is then a short pause in power or online versus offline energy then, assuming a slow release, the beam intensity will stay high for a period corresponding to the release time and only then will it go low. This allows for small pauses in speech without an intervening loss of beamforming.

Other advantages and features of the invention will be understood by those of ordinary skill in the art after referring to the complete written description of the preferred embodiments in conjunction with the following drawings.

DESCRIPTION OF THE PREFERRED EMBODIMENTS

Figure 1:
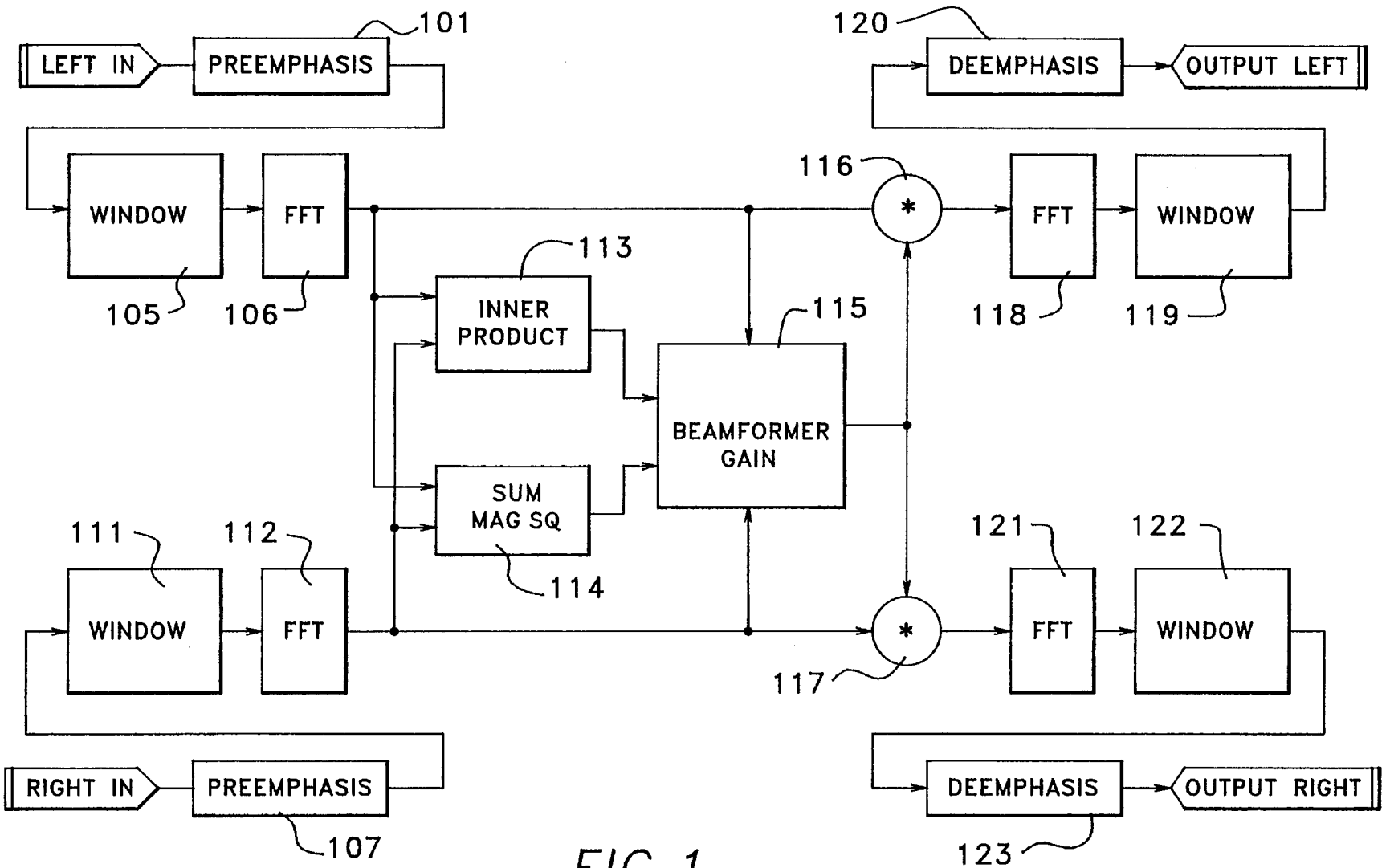
FIG. 1 illustrates the preferred embodiment of the present beamformer system for a binaural hearing aid.

In FIG. 1, the beamforming system, which is implemented as a DSP software program, is shown as an operations flow diagram. The left and right ear microphone signals have been digitized at the system sample rate $F_{samp}$ which is generally adjustable in a range over 8 kHz to 48 kHz, but rate. The left and right audio signals have little, or no, phase or magnitude distortion. A hearing aid system for providing such low distortion left and right audio signals is described in the above-identified cross-referenced patent application entitled "Binaural Hearing Aid." The time domain digital input signal from each ear is passed to one-zero pre-emphasis filters 101, 107. Pre-emphasis of the left and right ear signals using a simple one-zero high-pass differentiator pre-whitens the signals before they are transformed to the frequency domain. This results in reduced variance between frequency coefficients so that there are fewer problems with numerical error in the Fourier transformation process. The effects of the preemphasis filters 101, 107 are removed after inverse fourier transformation by using one-pole integrator deemphasis filters 120, 123 on the left, and right signals at the end of beamforming processing.

The beamforming operation in FIG. 1 is performed on M sample point blocks. The choice of M is a trade-off between frequency resolution and delay in the system. It is also a function of the selected sample rate. For the nominal 11,025 sample rate, a value of M=256 has been used. Therefore, the signal is processed in 256 point consecutive sample blocks. After each block is processed, the block origin is advanced by N=M/2 points. If the first block spans samples 0..255 of both the left and right channels, then the second block spans samples 128..383, the third spans samples 256..511, etc. The processing of each consecutive block is identical.

The beamforming processing begins by multiplying the left and right M point sample blocks by a sine window in operations 105, 111. A Fast Fourier Transform (FFT) operation 106, 112 is then performed on the left and right blocks. Since the signals are real, this yields an N=M/2 point complex frequency vector for both the left and right audio channels. The elements of the complex frequency vectors will be referred to as frequency bin values (there are N frequency bins from F=0 (DC) to $F=F_{samp}/2$ Khz).

Figure 2:
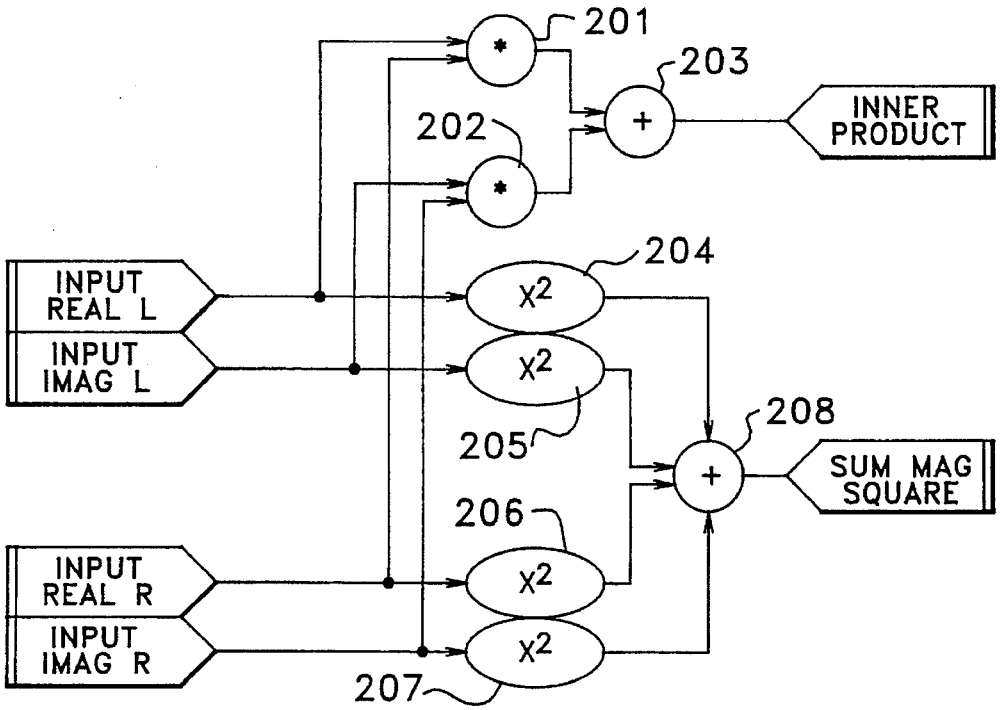
FIG. 2 shows the details of the inner product operation and the sum of magnitudes squared operation referred to in operation 113 and 114 of FIG. 1.

The inner product of, and the sum of magnitude squares of each frequency bin for the left and right channel complex frequency vector, are used to obtain a measure of the extent to which the sound at that frequency is online. The inner product of, and the sum of magnitude squares of each frequency bin is calculated by operations 113 and 114, respectively. The expression for the inner product is:

$$\text{Inner Product}(k)=\text{Real}(\text{Left}(k))*\text{Real}(\text{Right}(k))+\text{Imag}(\text{Left}(k))*\text{Imag}(\text{Right}(k)$$

and is implemented as shown in FIG. 2. The operation flow in FIG. 2 is repeated for each frequency bin. On the same FIG. 2, the sum of magnitude squares is calculated as:

$$\text{Magnitude Squared Sum}(k)=\text{Real}(\text{Left}(k))^2+\text{Real}(\text{Right}(k))^2+\text{Imag}(\text{Left}(k))^2+\text{Imag}(\text{Right}(k))^2.$$

An inner product and magnitude squared sum are calculated for each frequency bin forming two frequency domain vectors. The inner product and magnitude squared sum vectors are then passed to the beamformer gain operation 115. This gain operation uses the two vectors to calculate a gain per frequency bin.

Figure 3:
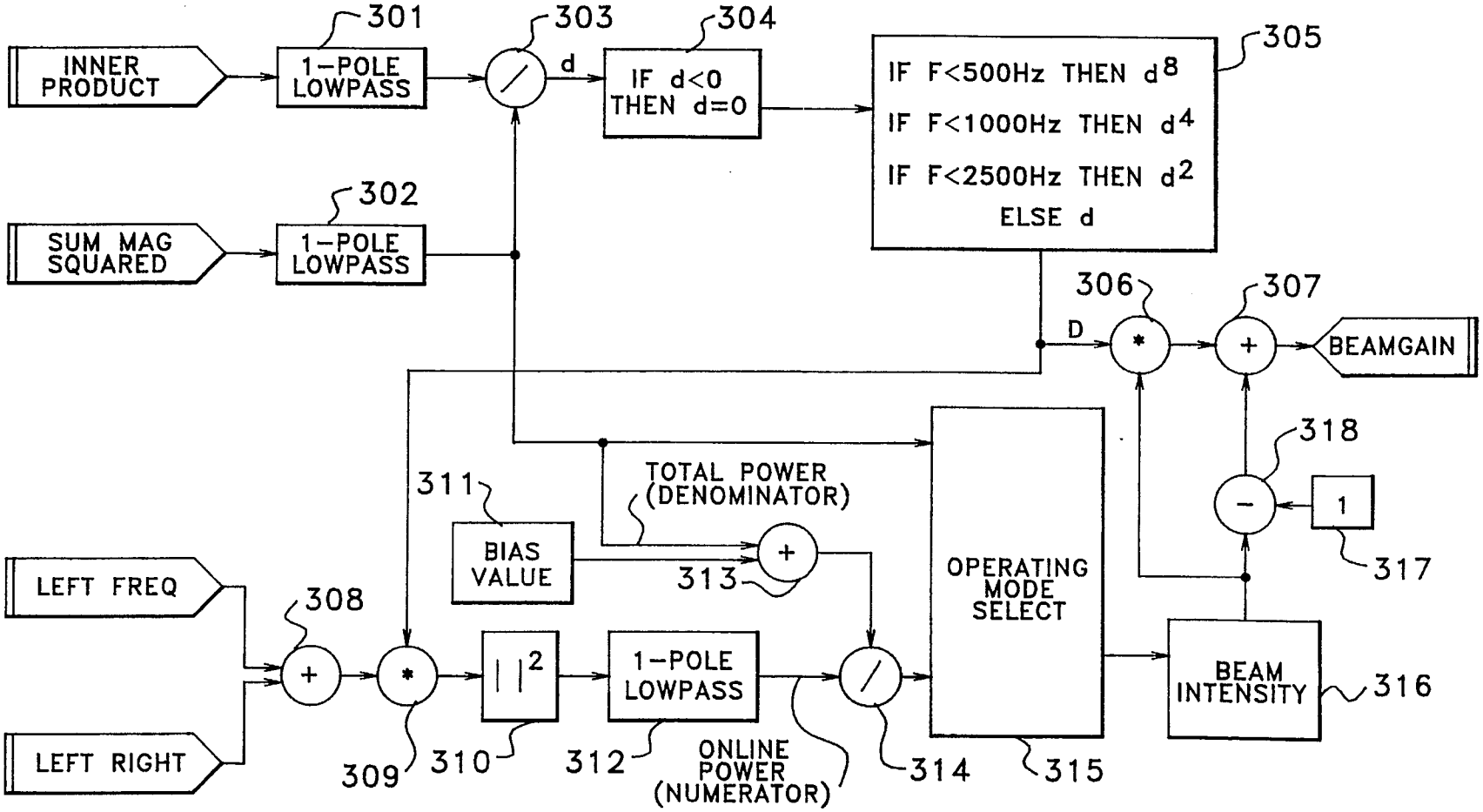
FIG. 3 shows the details of the beamformer gain operation referred to in operation 115 of FIG. 1.

The beamformer gain operation 115 in FIG. 1 is shown in detail in FIG. 3. The inner product and magnitude squared sum for each bin are smoothed temporally using one pole filters 301 and 302 in FIG. 3. The output of 302 (the smoothed sum of magnitude squared) will form the total power estimate used in calculating beam intensity. The ratio of the temporally smoothed inner product and magnitude squared sum is then generated by operation 303. This ratio is the preliminary direction estimate "d" equivalent to:

$$d=\text{Average}\{\text{Mag Left}(k)*\text{Mag Right}(k)*\cos[\text{Angle Left}(k)-\text{Angle Right}(k)]\}/\text{Average}(\text{Mag Sq Left}+\text{Mag Sq Right})$$

The ratio, or d estimate, is a function which equals 0.5 when the Angle Left=Angle Right and when Mag Left 32 Mag Right; that is, when the values for frequency bin k are the same in both the left and right channels. As the magnitude or phase angles differ, the function tends toward zero, and goes negative for PI/2<Angle Diff<3PI/2. For d negative, d is forced to zero in operation 304. It is significant that the d estimate uses both phase angle and magnitude differences, thus incorporating maximum information in the d estimate.

The direction estimate d is then passed through a frequency-dependent nonlinearity operation 305 which raises d to higher powers at lower frequencies to generate the final direction estimate vector D. For example, for frequencies F under 500 Hz, $D=d^8$. The effect is to cause the direction estimate to tend towards zero more rapidly at low frequencies. This is desirable since the wave lengths are longer at low frequencies and so the angle differences observed are smaller.

The generation of the beam intensity vector is carried out in operation 316 of FIG. 3, and requires an input power vector. The input power vector used depends on operating mode. In operating Mode One, the smoothed magnitude squared sum vector from single pole low pass filter 302 is used for beam intensity calculation. In operating Mode Two, a ratio between online power and biased total power is used.

The determination of the online power begins by summing the left and right frequency domain signals at summing operation 308. The sum at each frequency is multiplied by the direction estimate D in operation 309. The product is squared in operation 310 then smoothed in one-pole lowpass filter 312. The resulting online power corresponds to the smoothed magnitude square of the fully beamformed sum of left and right channels which is a measure of online power, as opposed to the original smoothed magnitude square vector which corresponds to total power.

The one-pole smoothing filters 302 and 312 have two coefficients each: An attack coefficient and a release coefficient. If the input to the smoothing filters is increasing, then the attack coefficient is used. If it is decreasing, then the release coefficient is used. This implements the attack-and-release time constants for beam intensity. These attack-and-release time constants are adjusted by changing the attack coefficient and the release coefficient in smoothing filters 302 and 312.

The online power for each frequency bin is the numerator for the ratio calculated in operation 314. The total power is available from the single pole, low pass filter 302. A small bias value from register 311 is added to the total power by summing operation 313. The bias value is big enough to guarantee that when the online power and total power are both very small, the resulting ratio from operation 314 will tend towards zero.

In operating Mode Two, this ratio is used to calculate beam intensity. The operating mode selector 315 selects between total power (Mode One), and the ratio of online power to biased total power (Mode Two) as the input vector which is sent on to the beam intensity operation 316. The operating mode selection is controlled by the user (i.e., the hearing aid wearer) to select the correct operating mode for a given sound environment.

Figure 4:
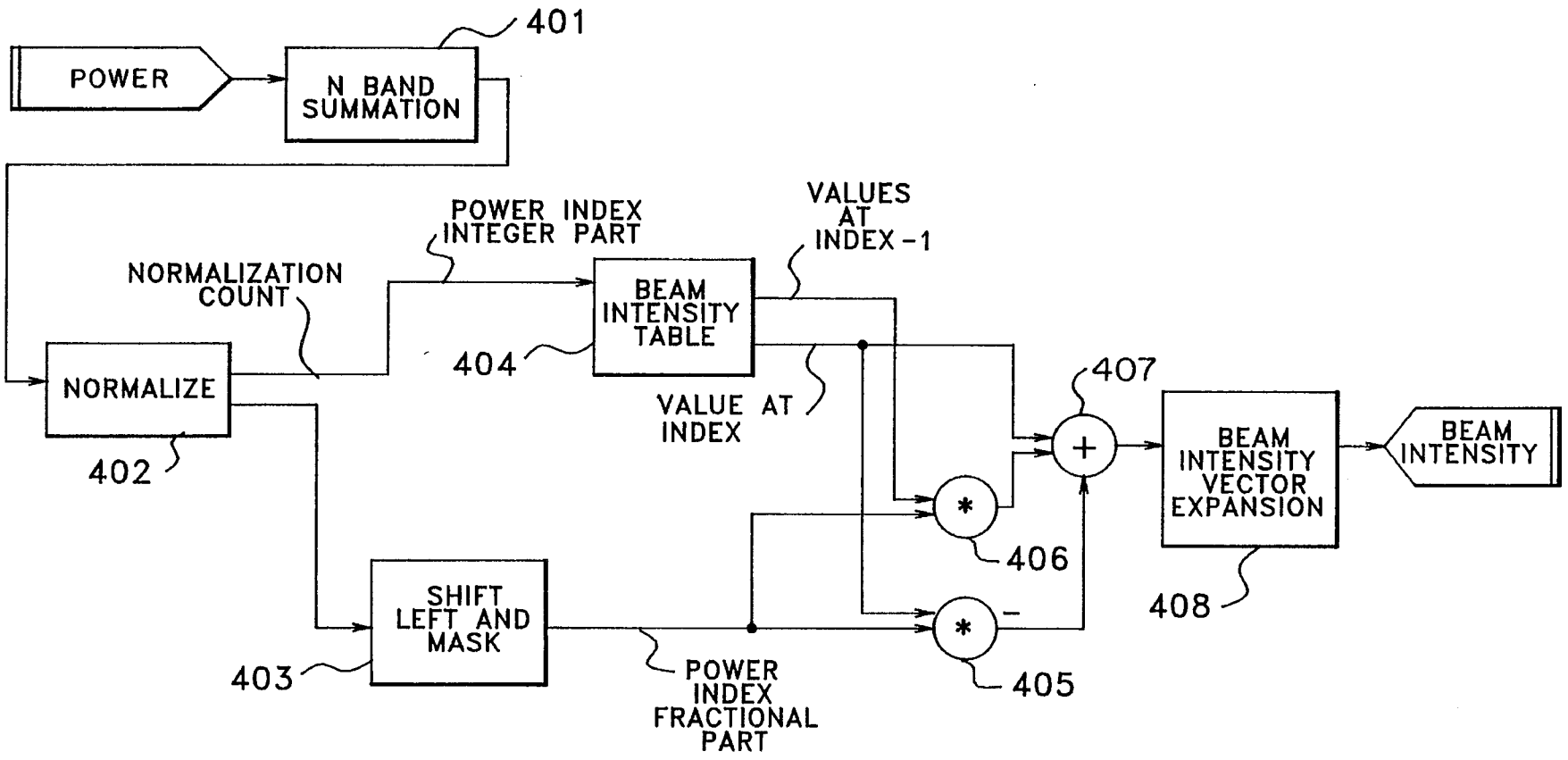
FIG. 4 shows the details of the beam intensity operation 316 of FIG. 3.

The beam intensity operation is detailed in FIG. 4. The beam intensity vector will be generated in P subbands, where P is smaller than the number of frequency bins N. A subband is a contiguous group of frequency bins. The subbands are non-overlapping and adjacent. A typical value for P is 3 which divides the frequency range into three adjacent bands for example, 0–1,000Hz, 1,000–3,000Hz, 3,000 –20,000Hz. In the simplest form of the beam intensity vector, P is one; i.e., the beam intensity factor is the same for the entire sound spectrum.

To generate the beam intensity vector, the first operation 401 in FIG. 4 sums, for each subband, the input power vector from mode selector 315 (FIG. 3) across all the frequency bins in the subband. The input to operation 401 of FIG. 4 is an N point frequency domain power vector, and the output is a P point frequency domain subband power vector. Every subsequent operation in FIG. 4 is then carried out on each point of the P point vector until the beam intensity expansion operation 408 of FIG. 4. Operation 408 converts the vector from a P point to an N point vector where every point in each subband has the same value.

The subband power vector values are normalized in operation 402 of FIG. 4. The number of left shifts required to normalize them, which reflects the logarithm to the base two of the fractional values, forms the integer part of the P point power index vector. The fractional part of the power index vector is made up of the normalized power vector values shifted left one additional time by operation 403 of FIG. 4 with the sign bit and overflow bits masked.

The power index vector is used to generate a P point vector of beam intensity values through a linearly interpolated table lookup operation. The integer part of each value in the Power Index vector is used as an index into the Beam Intensity Table 404 of FIG. 4. The output of the Beam Intensity Table is the value at the index offset into the table and the value at the index-1 offset into the table. The fraction part of the index is used to linearly interpolate between these consecutive table values using multiply operations 405 and 406 and summing operation 407 of FIG. 4. The resulting interpolated value is the Beam Intensity value, and there is one Beam Intensity value for every entry in the power index vector corresponding to one beam intensity for each subband.

Figure 5:
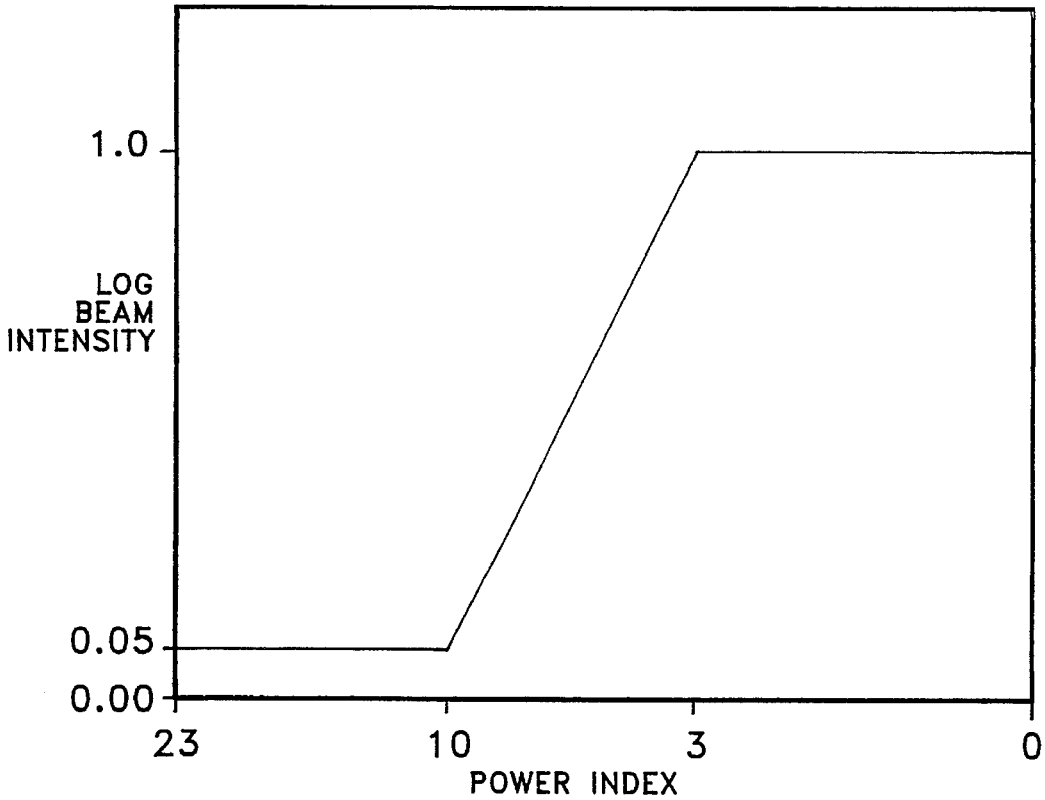
FIG. 5 shows the shape of the function implemented by the beam table operation 404 of FIG. 4

The Beam Intensity Table implements a function of power, as shown in FIG. 5. The Beam Intensity Table is designed in such a way that, at normal online speech levels, the beam intensity value is very nearly unity and, in the absence of online speech (in the case of Mode Two operation) or of any speech (in the case of Mode One operation), then the beam intensity value is nearly zero.

In FIG. 5, the table outputs a value of beam intensity between 1.0 and 0.0 on the vertical axis depending on the power index value input on the horizontal axis. The power index corresponds to the number of left shifts in the normalization process required to move the first "1" in the power binary data word to the left most value position. The normalization process is used to convert the range of power variations into a logarithmic scale. Each left shift in the power normalization corresponds to 3 db change in power. If there are 23 value bits (24 bit word with 23 value bits plus a sign bit) in the data word from summation 401 (FIG. 4), there are 23 possible shifts equivalent to a power range of 69 db. Thus, the power index varies from 23 at the left to 0 at the right in FIG. 5, and the lower values of power index correspond to higher input powers. For high powers, the beam intensity value is near unity, and for low powers the beam intensity value is near zero.

The break points for the beam intensity transition curve are typically near power index values of 3 and 10 as shown in FIG. 5. The beam intensity function in FIG. 5 is set up by selecting the upper breakpoint at a place where beamforming operation is reasonably stable; i.e., slight changes in power do not cause the beamformer to jitter on and off. A power index in the range of 2–5 is about right for the upper breakpoint. The lower breakpoint is selected so there will be a graceful transition between beamforming and non-beamforming. If the transition is not graceful, the sound produced will abruptly snap between beamforming and non-beamforming. A difference of 5–9 in power index between upper and lower breakpoints provide a sufficiently smooth transition.

In FIG. 4, operation 408 expands the beam intensity vector. The direction estimate vector is N points long, with one point for every frequency bin (i.e., 128 points). The beam intensity vector is shorter, P points, with one point per subband (i.e., P=3 subbands). The beam intensity vector is expanded in length to equal the length of D in operation 408. This expansion involves repeating the subband beam intensity for every frequency bin in the subband. The expanded beam intensity vector is then combined with the direction estimate vector D to form the beamformer gain vector as shown in FIG. 3.

In FIG. 3, each element of the beam intensity vector is multiplied against corresponding element of the direction estimate vector D at operation 306. At the same time, one is subtracted from each element of the beam intensity vector, and the result is added by operation 307 to the product from operation 306. Accordingly, the beam gain vector values can be determined per the following formula:

$$G=D*B+(1-B)$$

where:

G=beamformer gain

D=direction estimate

B=beam intensity

When the beam intensity B for a particular frequency approaches one, then the beamformer gain G for that frequency will follow the direction estimate D for that frequency. As the beam intensity B for a frequency approaches zero, the beamformer gain G for that frequency approaches unity with direction estimate vector D playing a smaller and smaller role. N points of Beamformer Gain G are generated, one for every point in the N point direction estimate and expanded beam intensity vectors.

In FIG. 1, the beamforming gain is used by multipliers 116 and 117 to scale (amplify or attenuate depending on the gain value) the original left and right ear frequency domain signals. The left and right ear noise-reduced frequency domain signals are then inverse transformed at FFTs 118 and 121. The resulting time domain segments are windowed with a sine window and 2:1 overlap-added to generate a left and right signal from window operations 119 and 122. The left and right signals are then passed through deemphasis filters 120, 123 to produce the stereo output signal.

While a preferred embodiment of the invention has been shown and described, it will be appreciated by one skilled in the art, that a number of further variations or modifications may be made without departing from the spirit and scope of my invention.

References Cited In the Specification:

1. Evaluation of an adaptive beamforming method for hearing aids. J. Acoustic Society of America 91(3). Greenberg, Zurek.
2. Improvement of Speech Intelligibility in Noise: Development and Evaluation of a New Directional Hearing Instrument Based on Array Technology. Thesis from Delft University of Technology. Willem Soede
3. Multimicrophone adaptive beamforming for interference reduction in hearing aids. Journal of Rehabilitation Research and Development, Vol. 24 No. 4. Peterson, Durlach, Rabinowitz, Zurek.
4. An Alternative Approach to Linearly Constrained Adaptive Beamforming. IEEE Transactions on Antennas and Propagation. Vol. AP-30 N0. 1 Griffiths, Jim.
5. Gaik W., Lindemann W. (1986) Ein digitales Richtungsfilter basierend auf der Auswertung Interauraler Parameter von Kunstkoppfsignalen. In: Fortschritte der Akustik-DAGA 1986.
6. Kollmeier, Hohmann, Peissig (1992) Digital Signal Processing for Binaural Hearing Aids. Proceedings, International Congress on Acoustics 1992, Beijing, China.
7. Bodden Proceedings, (1992) Cocktail-Party-Processing: Concept and Results. International Congress on Acoustics 1992, Beijing, China.
8. Gaik (1990): Untersuchungen zur binaurelen Verarbeitung kopfbesogener Signale. Fortschr.-Be. VDI Reihe 17 Nr. 63. Dusseldorf: VDI-Verlag.

9. Lindemann W. (1986): Extension of a binaural cross-correlation model by contralateral inhibition. I. Simulation of lateralization of stationary signals. JASA 80, 1608–1622.

What is claimed is:

1. Selective signal processing in a radiant energy signal processing apparatus for processing signals received by a plurality of sensors oriented in a predetermined viewing direction, said apparatus comprising:

beamforming means responsive to the signals from the plurality of sensors for separating online signals arriving at the sensors in a direction near the viewing direction from off-line signals arriving from other directions;

monitoring means for monitoring a plurality of the signals and determining a signal strength for the plurality of signals and enabling means responsive to the signal strength for enabling said beamforming means when the signal strength is high and for inhibiting said beamforming means when the signal strength is low.

2. The apparatus of claim 1 wherein said monitoring means comprises:

means for summing the power of all signals to generate a power index; and means responsive to the power index for providing a beam intensity value indicative of the signal strength, said beam intensity value being a first value when the signal strength is high and being a second value when the signal strength is low.

3. The apparatus of claim 2 wherein said enabling means comprises:

means responsive to said first value for amplifying the online signal and the off-line signals by a gain dependent on the direction of arrival of the signals whereby the online signals are enhanced and the off-line signals are attenuated; and means responsive to said second value for amplifying the online signals and the offline signals uniformly whereby all signals are enhanced equally.

4. The apparatus of claim 1 and in addition:

means for transforming the online and off-line signals into frequency components;

means for summing the power of all signal components within one or more frequency bands to produce a power index for each frequency band; and means responsive to the power index in each frequency band for providing a beam intensity value indicative of a combined strength for all signal components within the frequency band, said beam intensity being a first value when the combined strength is high and being a second value when the combined strength is low.

5. The apparatus of claim 4 wherein said enabling means comprises:

means responsive to said first value for each frequency band for amplifying the online signal components and the off-line signal frequency components within the band by a gain dependent on the direction of arrival of the signal components whereby the online signal components are enhanced and the off-line signal components are attenuated; and means responsive to said second value for each frequency band for amplifying the online signal components and the off-line signal components within the band uniformly whereby all signals are enhanced equally.

6. The apparatus of claim 1 wherein said monitoring means comprises:

means for summing the power of all signals to determine all signal power;

means for summing the power of online signals to determine online signal power;

means for taking the ratio of the online signal power to all signal power and producing a power index indicative of the ratio; and means responsive to the power index for providing a beam intensity value indicative of the relative strength of the online signals to all signals, said beam intensity value being a first value as the ratio approaches one and being a second value as the ratio approaches zero.

7. The apparatus of claim 1 wherein said enabling means comprises:

means responsive to said first value for amplifying the online signals and off-line signals by a gain dependent on the direction of arrival of the signals whereby the online signals are enhanced and the off-line signals are attenuated; and means responsive to said second value for amplifying the online signals and the offline signals uniformly whereby all signals are enhanced equally.

8. The apparatus of claim 1 and in addition:

means for transforming the online and off-line signals into frequency components;

means for summing the power of all signal components within one or more frequency bands to determine all signal power;

means for summing the power of all online signal components within one or more frequency bands to determine online signal power;

means for taking the ratio of the online signal power to the all signal power in each frequency band and producing a power index indicative of the ratio in each frequency band; and means responsive to the power index for providing a beam intensity value indicative of the relative strength in each frequency band of the online signal components to all signal components, said beam intensity value being a first value when as the ratio approaches one and being a second value as the ratio approaches zero.

9. The apparatus of claim 8 wherein said enabling means comprises:

means responsive to said first value for amplifying the online signal components and off-line signal components by a gain dependent on the direction of arrival of the signals whereby the online signals are enhanced and the off-line signals are attenuated; and means responsive to said second value for amplifying the online signal components and the off-line signal components uniformly whereby all signals are enhanced equally.

10. In a binaural hearing aid, beamforming apparatus for reducing noise in the sound signal provided by the hearing aid to a user, said hearing aid processing left and right frequency domain vectors corresponding to left and right audio signals, said beamforming apparatus comprising:

means responsive to the left and right frequency domain vectors for generating a direction estimate vector indicating a direction an audio signal is coming from relative to the line of sight of the hearing aid user;

means responsive to the left and right frequency domain vectors for generating a beam intensity vector indicating strength of the sound arriving at the hearing aid wearer;

means for scaling the direction estimate vector with the beam intensity vector to produce a beam gain vector, said beam gain vector is similar to the direction estimate vector for high beam intensity strength and approaches a uniform value irrespective of the direction estimate vector as the strength of the beam intensity vector decreases; and means for amplifying the right and left sound frequency domain vectors with the beam gain vector whereby for high beam intensity strength the left and right signals are beamformed and as the beam intensity strength decreases the beamforming of the left and right signals decreases until for low beam intensity strength there is no beamforming.

11. The apparatus of claim 10 wherein said beam intensity vector is a function of the power of the sum of the left and right frequency domain vectors.

12. The apparatus of claim 10 wherein said beam intensity vector is a function of the ratio between power of the sum of the left and right frequency domain vectors after beamforming to the power of the sum of the left and right frequency domain vectors before beamforming.

13. Audio signal processing apparatus for processing audio signals received by a plurality of audio sensors oriented in a predetermined viewing direction, said apparatus comprising:

a beamformer responsive to the audio signals from the plurality of sensors for separating online signals arriving at the audio sensors in a direction near the viewing directions from off-line signals arriving from other directions;

a monitor for monitoring signals and determining a signal strength for a plurality of the audio signals from the audio sensors; and beamformer enabler responsive to the signal strength for enabling said beamformer when the signal strength is high and for inhibiting said beamformer when the signal strength is low.

14. The apparatus of claim 13 wherein said monitor comprises:

a power summer for summing the power in a plurality of the audio signals to generate a power index; and beam intensity value generator responsive to the power index for providing a beam intensity value indicative of the signal strength for the plurality of audio signals, said beam intensity value being a first value when the signal strength is high and being a second value when the signal strength is low.

15. The apparatus of claim 14 wherein said beamformer enabler comprises:

an amplifier responsive to said first value for amplifying the online signals and the off-line signals by a gain dependent on the direction of arrival of the signals whereby the online signals are enhanced and the off-line signals are attenuated; and said amplifier responsive to said second value for amplifying the online signals and the off-line signals uniformly whereby all signals are enhanced equally.

16. The apparatus of claim 13 and in addition:

an analyzer for transforming the audio signals into audio frequency domain vectors;

power subband summer for summing the power in the audio frequency domain vectors within one or more frequency subbands of frequencies in the audio frequency domain vectors to produce a power index for each frequency subband; and beam intensity vector generator responsive to the power index in each frequency subband for providing a beam intensity vector indicative of power in the audio signals at each frequency in the audio frequency domain vectors.

17. The apparatus of claim 16 wherein said beamformer comprises:

direction estimator responsive to the audio signal frequency domain vectors for generating a direction estimate vector indicating a direction an audio signal is coming from relative to the viewing direction;

an amplifier for amplifying the audio signal frequency domain vectors with a beam gain vector dependent upon the direction estimate vector.

18. The apparatus of claim 17 wherein said beamformer enabler comprises:

a vector scaler for scaling the direction estimate vector with the beam intensity vector to produce the beam gain vector whereby said beam gain vector is similar to the direction estimate vector for high beam intensity strength and approaches a uniform value irrespective of the direction estimate vector as the strength of the beam intensity vector decreases.

* * * * *